US006852962B2

(12) United States Patent
Kang et al.

(10) Patent No.: US 6,852,962 B2
(45) Date of Patent: Feb. 8, 2005

(54) MICROWAVE OVEN

(75) Inventors: Han-Seong Kang, Suwon (KR); Dae-Sung Han, Hwasung (KR); Yong-Woon Han, Kunpo (KR); Kwang-Seok Kang, Suwon (KR); Seong-Deog Jang, Suwon (KR)

(73) Assignee: Samsung Electronic Co., Ltd., Suwon (KR)

( * ) Notice: Subject to any disclaimer, the term of this patent is extended or adjusted under 35 U.S.C. 154(b) by 0 days.

(21) Appl. No.: 10/172,002

(22) Filed: Jun. 17, 2002

(65) Prior Publication Data

US 2003/0146211 A1 Aug. 7, 2003

(30) Foreign Application Priority Data

Feb. 6, 2002 (KR) ..... 2002-6701

(51) Int. Cl.[7] ..... H05B 6/78
(52) U.S. Cl. ..... 219/754; 219/762
(58) Field of Search ..... 219/754, 762, 219/746, 745, 751, 718, 756, 763, 681; 126/338, 339, 340

(56) References Cited

U.S. PATENT DOCUMENTS 4,954,680 A * 9/1990 Takenouchi ..... 219/763
5,693,246 A 12/1997 Han et al.
5,786,580 A * 7/1998 Yeo ..... 219/752
6,002,120 A * 12/1999 De Matteis ..... 219/754
6,252,214 B1 * 6/2001 Han et al. ..... 219/754

* cited by examiner

*Primary Examiner*—Quang T Van
(74) *Attorney, Agent, or Firm*—Staas & Halsey LLP

(57) ABSTRACT

A microwave oven includes a tray holding unit which stably holds both a cooking tray and a tray guide at their original positions regardless of vibration and impact applied to the cooking tray and/or tray guide. The tray holding unit includes a base part, and elastic blade parts which are formed on both sides of a lower surface of the base part and extend downward from the lower surface while being inclined outward at an angle of inclination. A stop rail is horizontally formed along an inner surface of left and right sidewalls of a cooking cavity of the microwave oven, so as to stop top edges of the base part and allows the blade parts to press down on the cooking tray. Accordingly, the cooking tray and the tray guide are stably held down by the tray holding unit.

8 Claims, 5 Drawing Sheets

MICROWAVE OVEN

CROSS-REFERENCE TO RELATED APPLICATIONS

This application claims the benefit of Korean Patent Application No. 2002-6701 filed on Feb. 6, 2002, in the Korean Industrial Property Office, the disclosure of which is incorporated herein by reference.

BACKGROUND OF THE INVENTION

1. Field of the Invention

The present invention relates to microwave ovens and, more particularly, to a microwave oven provided with a tray holding unit which stably holds a cooking tray and a tray guide of the microwave oven so as to prevent the cooking tray and the tray guide from moving from their original positions regardless of vibration and impact applied to the microwave oven, during for example, where the microwave oven is carried by a moving vehicle.

2. Description of the Related Art

A microwave oven is an electrically operated oven which heats and/or cooks food contained in its cooking cavity using high-frequency electromagnetic waves generated by the oscillation of a magnetron installed in a machine room. That is, during an operation of the microwave oven, the magnetron inside the machine room of the microwave oven radiates the high-frequency electromagnetic waves, so-called "microwaves," through the cooking cavity. The microwaves thus penetrate food so as to repeatedly change the molecular arrangement of moisture laden in the food. That is, the molecules of the moisture are vibrated to generate a frictional heat within the food to cook the food.

Microwave ovens are typically designed to be operated by AC power and used in a kitchen having an AC power supply. However, in recent years, a microwave oven operated by DC power has been proposed and used in both indoors (at home or restaurants) and outdoors (in a vehicle or boats).

FIG. 1 shows the construction of a conventional microwave oven. The conventional microwave oven comprises a cabinet 1 which forms the outer appearance of the microwave oven and a cooking cavity 2 which is defined inside the cabinet 1 with an opening at front and used for cooking food therein. A machine room 3 is defined inside the cabinet 1 at a position under the cooking cavity 2, and receives a variety of devices used for generating microwaves, which are transmitted into the cooking cavity 2 to heat and cook the food inside the cooking cavity 2.

A cooking tray 4 is set on a bottom of the cooking cavity 2 and seats food thereon. A tray guide 5, with a plurality of rollers 6, is set between the cooking tray 4 and the bottom of the cooking cavity 2 to rotatably support the cooking tray 4 on the bottom of the cooking cavity 2.

Seated in the machine room 3 are a magnetron 7 which generates microwaves and a drive motor 9 which rotates the cooking tray 4 set in the cooking cavity 2. The microwave oven also has a wave guide 8 which guides the microwaves from the magnetron 7 into the cooking cavity 2.

In an operation of the microwave oven, microwaves generated from the magnetron 7 are transmitted into the cooking cavity 2 through the wave guide 8, while the cooking tray 4 loaded with food thereon is rotated by the drive motor 9. In such a case, the cooking tray 4 is slowly rotated at a low speed under the guide of the tray guide 5, and the food is heated and cooked by the microwaves.

In such a conventional microwave oven, the tray guide 5 having the rollers 6 is simply laid on the bottom of the cooking cavity 2, and so it is undesirably movable in horizontal and vertical directions. In addition, the cooking tray 4, coupled to a rotating shaft of the drive motor 9, is laid on the rollers 6 of the tray guide. Thus, the cooking tray 4 is also undesirably movable in horizontal and vertical directions. Therefore, the cooking tray 4 and the tray guide 5 may be forcefully moved from their original positions to be damaged or broken while being transported by, for example, a moving vehicle. In addition, when the cooking tray 4 and the tray guide 5 are moved in horizontal and vertical directions due to the moving vehicle (i.e., a mobile home), they also generate frictional noises, upsetting those around the microwave oven.

SUMMARY OF THE INVENTION

Accordingly, it is an object of the present invention to provide a microwave oven provided with a tray holding unit which stably holds both a cooking tray and a tray guide in their original positions regardless of vibration and impact applied, from the outside, to the microwave oven.

Additional objects and advantages of the invention will be set forth in part in the description which follows and, in part, will be obvious from the description, or may be learned by practice of the invention.

To achieve the above and other objects of the present invention, there is provided a microwave oven comprising a cabinet which forms an appearance of the microwave oven, a magnetron which generates microwaves and contained in the cabinet, a cooking cavity defined inside the cabinet for containing food therein, a tray guide having rollers and rotatably set in the cooking cavity, a cooking tray laid on the rollers of the tray guide, and a tray holding unit which holds the cooking tray at a position to prevent the cooking tray from moving regardless of vibration or impact applied to the cooking tray.

According to an aspect of the present invention, the tray holding unit comprises a base part which extends in a horizontal direction and elastic blade parts which are formed on a lower surface of the base part and extend downward from the lower surface of the base part while being inclined outward at an angle of inclination.

According to another aspect of the present invention, the microwave oven includes a stop rail which is horizontally formed along inner sidewalls of the cooking cavity at a position vertically spaced apart from the cooking tray by a predetermined height, wherein the stop rail stops an associated top edge of the base part, and the elastic blade parts bias against the cooking tray so as to hold and not allow movement of the cooking tray and the tray guide. The height between the stop rail and the cooking tray is shorter than the height of the tray holding unit where the elastic blade parts are not pressed, but is longer than the height of the tray holding unit where the elastic blade parts are fully pressed down.

According to yet another aspect of the present invention, the tray holding unit comprises a hollow inner cylindrical part having an opening at a first end thereof, a hollow outer cylindrical part having an opening at a first end thereof and fitted over the first end of the hollow inner cylindrical part, and an elastic member set in the hollow inner and outer cylindrical parts, wherein both ends of the elastic member are respectively stopped by a second end of the hollow inner cylindrical part and a second end of the hollow outer cylindrical part so as to allow the hollow inner and outer cylindrical parts to be axially movable relative to each other in opposite directions. Accordingly, the tray holding unit prevents moving of the cooking tray and the tray guide in response to the second end of the hollow inner cylindrical part being seated on the cooking tray and the second end of the hollow outer cylindrical part being biased against a top wall of the cooking cavity.

Guide slots, each having a predetermined length, may be formed on a sidewall of the hollow outer cylindrical part. Guide protrusions may be formed at the first end of the hollow inner cylindrical part, whereby the hollow inner and outer cylindrical parts are assembled with each other by engagement of the guide protrusions with the guide slots.

One or more push handles may extend outward from the first end of the hollow outer cylindrical part so as to push the hollow outer cylindrical part toward the hollow inner cylindrical part.

A rubber sheet may be attached to each of a second end surface of the hollow outer cylindrical part and a second end surface of the inner cylindrical part to prevent the two end surfaces from slippage.

The elastic member set in the hollow inner and outer cylindrical parts may be a coil spring.

BRIEF DESCRIPTION OF THE DRAWINGS

These and other objects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
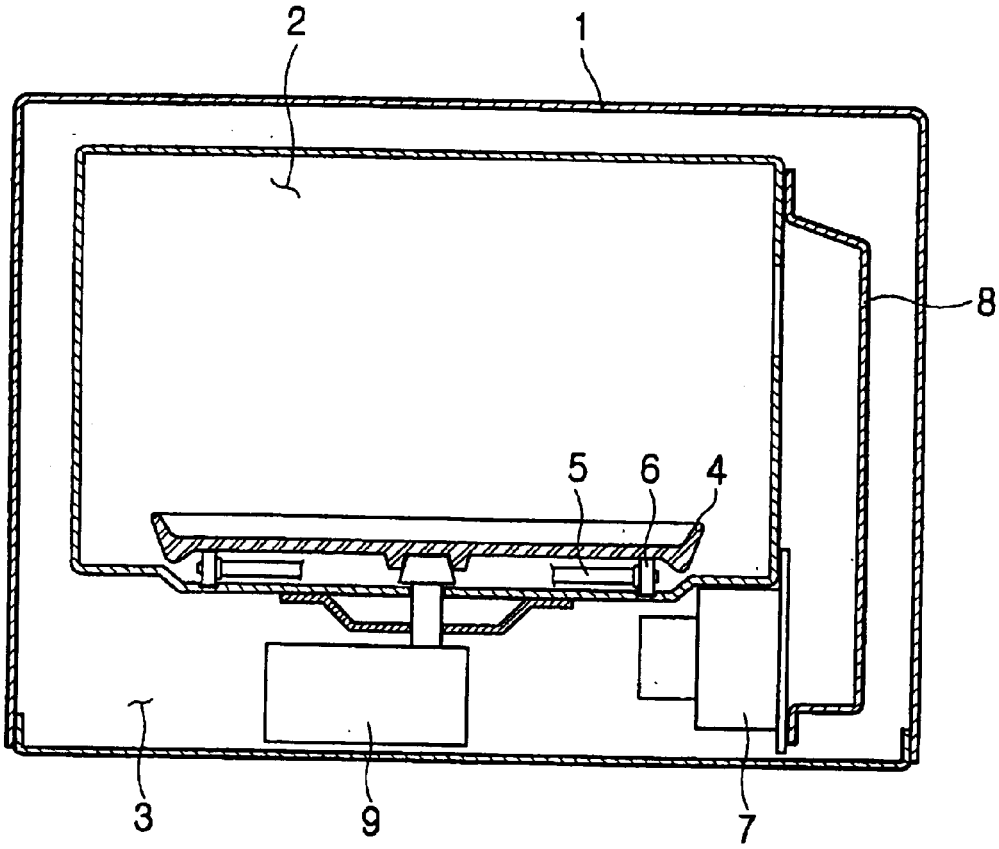
FIG. 1 (PRIOR ART)
FIG. 1 is a sectional view of a conventional microwave oven.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 2:
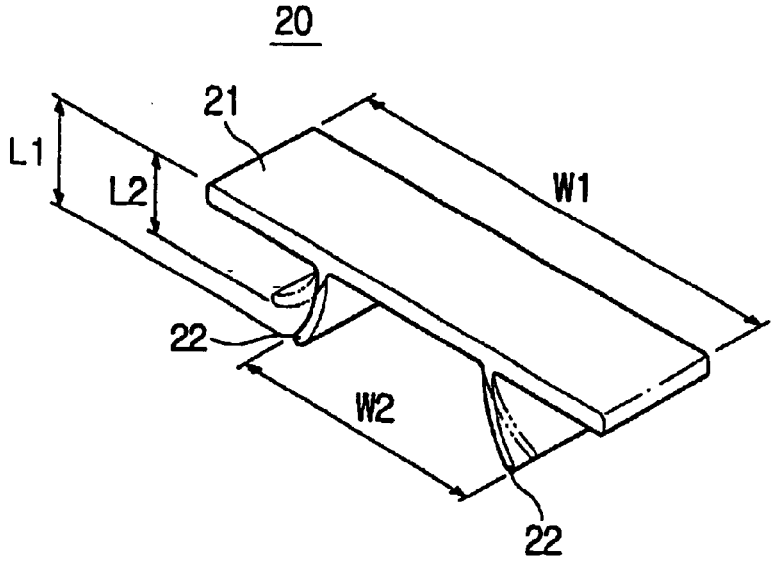
FIG. 2 is a perspective view of a tray holding unit according to an embodiment of the present invention.
Figure 3:
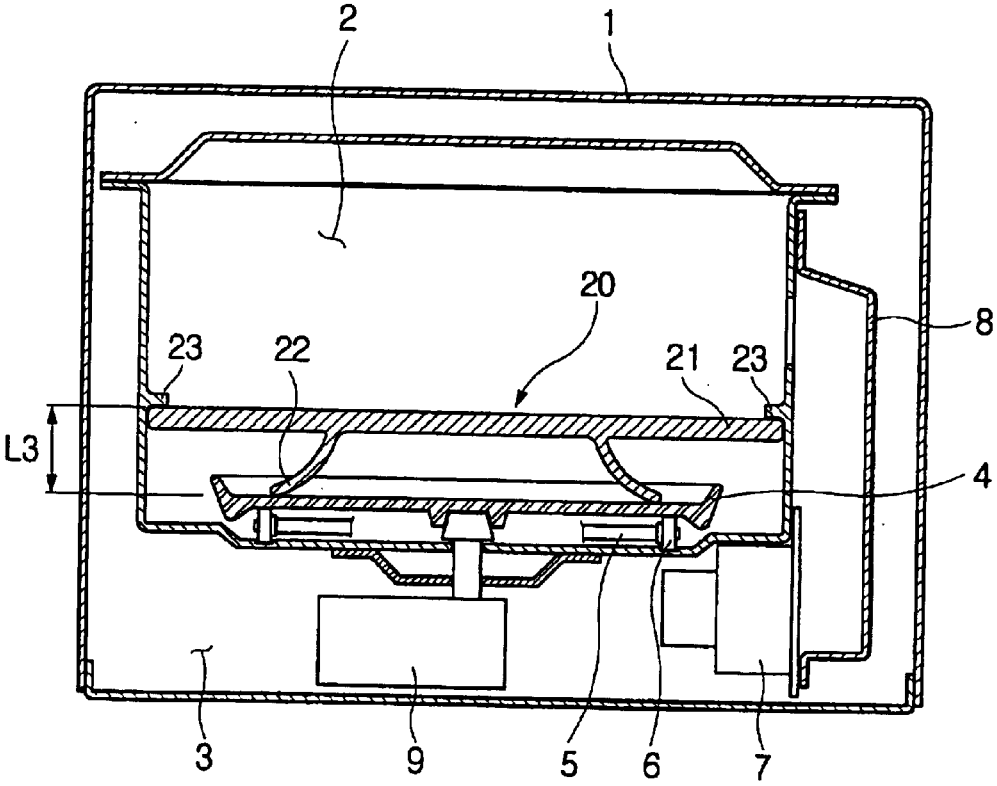
FIG. 3 is a sectional view of a microwave oven with the tray holding unit of FIG. 2 installed in a cooking cavity of the microwave oven according to the present invention.

FIG. 2 shows a tray holding unit 20 according to an embodiment of the present invention. FIG. 3 shows a microwave oven having the tray holding unit 20 of FIG. 2 installed in a cooking cavity 2 of the microwave oven.

As shown in FIG. 2, the tray holding unit 20 comprises a horizontal flat base part 21 ("base part") which is a longitudinal panel-shaped part extending in a horizontal direction. Two elastic blade parts 22 are formed on respective opposite sides of a lower surface of the base part 21 so as to extend downward from the lower surface of the base part 21 while being inclined outward at a predetermined angle of inclination.

The base part 21 and the two blade parts 22 are made of a material having elasticity and high strength, such as a plastic material, to form a single structure.

As shown in FIGS. 2 and 3, the length W1 of the base part 21 is set to be almost equal to the length of the cooking cavity 2. The two blade parts 22 inclinedly extend downward and outward from the lower surface of the base part 21 at predetermined left and right positions to press down on the cooking tray 4. The gap W2 between ends of the two blade parts 22 is set to be shorter than the diameter of the cooking tray 4.

In the tray holding unit 20, it is necessary for the base part 21 to have high strength, and for the two blade parts 22 to have high elasticity. In order to accomplish the above object, the base part 21 is designed to be thicker, while the two blade parts 22 are designed to be thinner than the base part 21.

Accordingly, the tray holding unit 20 elastically deforms in response to an external pressing force. That is, when a user applies, for example, an upward pressing force to the two blade parts 22 while holding the base part 21 with two hands, the two blade parts 22 are elastically deformed to be bent upward to be closer to the base part 21 while enlarging the gap W2 between them as shown by two-dot chain lines of FIG. 2. When the upward pressing force is removed from the two blade parts 22, the blade parts 22 are elastically restored to their original shapes and positions.

In other words, the two blade parts 22 of the tray holding unit 20 are each elastically deformed within a range determined by a subtraction of a reduced height L2, between the end of each blade part 22 and a top surface of the base part 21 as the blade parts 22 are pressed upward, from an original height L1 of the tray holding unit 20 when the blade parts 22 are not pressed.

With reference to FIG. 2, installation of the above-mentioned tray holding unit 20 to the microwave oven of FIG. 3, so as to prevent undesired movement of the cooking tray 4 and the tray guide 5 of the microwave oven, will be described.

The cooking tray 4 is installed on a bottom of the cooking cavity 2 of the microwave oven, with a tray guide 5 having rollers 6 and set between the cooking tray 4 and the bottom of the cooking cavity 2. The trade guide 5 rotatably supports the cooking tray 4 on the bottom of the cooking cavity 2.

Two stop rails 23, each having a predetermined length, are horizontally formed along inner surfaces of left and right sidewalls of the cooking cavity 2 at positions with the same height from the cooking tray 4. The two stop rails 23 stop the opposite top edges of the base part 21 to hold the tray holding unit 20 in the cooking cavity 2.

The height L3 between a lower surface of each stop rail 23 and a top surface of the cooking tray 4 is shorter than the original height L1 of the unloaded tray holding unit 20, and longer than the reduced height L2 of the tray holding unit 20.

In order to install the tray holding unit 20 in the cooking cavity 2 to hold the cooking tray 4 and the tray guide 5 in their original positions while transporting the microwave oven, the tray holding unit 20 is seated in a space between the two stop rails 23 and the cooking tray 4 inside the cooking cavity 2 while pressing the two blade parts 22 upward with two hands to reduce the height of the tray holding unit 20 to the reduced height L2. In such a case, the base part 21 is stopped by the two stop rails 23, while the two pressed blade parts 22 provide a biasing force to hold down the cooking tray 4 and the tray guide 5. The biasing force is generated from an elastic force which restores the two blade parts 22 to their original positions. The ends of the two blade parts 22 come in contact with the top surface of the cooking tray 4. Therefore, the cooking tray 4 and the tray guide 5 are elastically held by the tray holding unit 20, which also effectively absorbs vibration and impact applied to the cooking tray 4 and the tray guide 5 from the outside. The cooking tray 4 and the tray guide 5 are maintained at their desired positions without being moved or damaged regardless of the vibration and the impact.

To use the microwave oven for heating or cooking food, the tray holding unit 20 is removed from the cooking cavity 2 while pressing the two blade parts 22 upward. The removal of the tray holding unit 20 from the oven is simple to accomplish.

The construction and operation of a tray holding unit for a microwave oven according to another embodiment of the present invention will be described below with reference to FIGS. 4 and 5.

Figure 4:
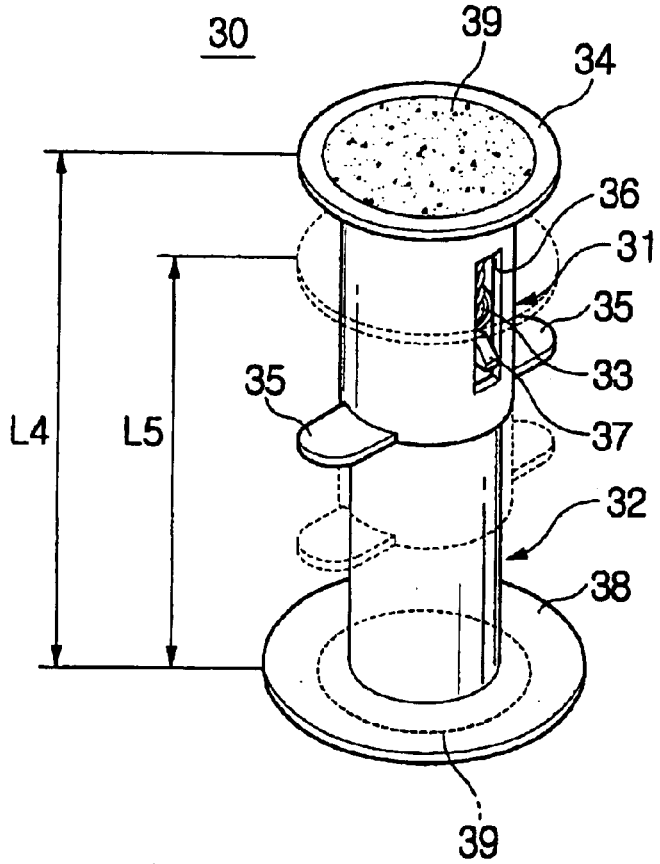
FIG. 4 is a perspective view of a tray holding unit according to another embodiment of the present invention.

FIG. 4 shows a tray holding unit 30 according to the another embodiment of the present invention. FIG. 5 shows a sectional view of a microwave oven with the tray holding unit 30 of FIG. 4 installed in a cooking cavity 2.

As shown in FIG. 4, the tray holding unit 30 comprises inner and outer cylindrical parts 32 and 31. The outer cylindrical part 31 is a hollow cylindrical body, which is closed at its upper end, but is open at its lower end. The inner cylindrical part 32 is a hollow cylindrical body, which is open at its upper end, but is closed at its lower end. The open end of the inner cylindrical part 32 is axially inserted into the open end of the outer cylindrical part 31, thus forming a telescopic cylinder assembly. An elastic member 33 is axially set in the telescopic cylinder assembly such that the closed ends of the two cylindrical parts 31 and 32 stop both ends of the elastic member 33.

An upper horizontal annular flange 34 is continuously formed along a circular edge of the closed end of the outer cylindrical part 31, while two push handles 35 having a predetermined length horizontally extend outward from the open end of the outer cylindrical part 31 at diametrically opposite positions. Two guide slots 36, having a predetermined length, are vertically formed on a sidewall of the outer cylindrical part 31 at diametrically opposite positions.

While the number of the guide slots 36 is set to two, it is understood that the number of the vertical guide slots 36 is not limited to two, and three or more guide slots may be formed on the sidewall of the outer cylindrical part 31 without affecting the functioning of the present invention.

Two guide protrusions 37 are outwardly formed at the open end of the inner cylindrical part 32 at diametrically opposite positions, and engage with the two guide slots 36 of the outer cylindrical part 31, respectively, where the inner cylindrical part 32 is axially inserted into the outer cylindrical part 31 to form the telescopic cylinder assembly. In the telescopic cylinder assembly, the two cylindrical parts 31 and 32 are telescopically extended from or pressed to each other in an axial direction while being normally biased in opposite directions by the elastic member 33. In such a case, the extension of the two cylindrical parts 31 and 32 from each other is limited by the movable engagement of the guide protrusions 37 with the guide slots 36.

A compression coil spring having a predetermined elastic modulus may be used as the elastic member 33.

A lower horizontal annular flange 38 is continuously formed along a circular edge of the closed end of the inner cylindrical part 32 so as to correspond to the flange 34 of the outer cylindrical part 31. A rubber sheet 39 is attached to an outer surface of each closed end of the two cylindrical parts 31 and 32, and allows the tray holding unit 30 to be stably positioned at its desired place inside the cooking cavity 2 of the microwave oven without slippage.

In the present invention, the two cylindrical parts 31 and 32 can be made of a plastic material, which is light, somewhat elastic and desirably strong. When the two cylindrical parts 31 and 32 are assembled to each other to form a single body, the open end of the inner cylindrical part 32 is axially inserted into the open end of the outer cylindrical part 31 while slightly opening the open end of the outer cylindrical part 31 and slightly pressing the open end of the inner cylindrical part 32 after axially seating the elastic member 33 inside the two aligned cylindrical parts 31 and 32. As described above, the two cylindrical parts 31 and 32 are assembled to each other to form the tray holding unit 30 with the two guide protrusions 37 of the inner cylindrical part 32 engaging with the two guide slots 36 of the outer cylindrical part 31.

Figure 5:
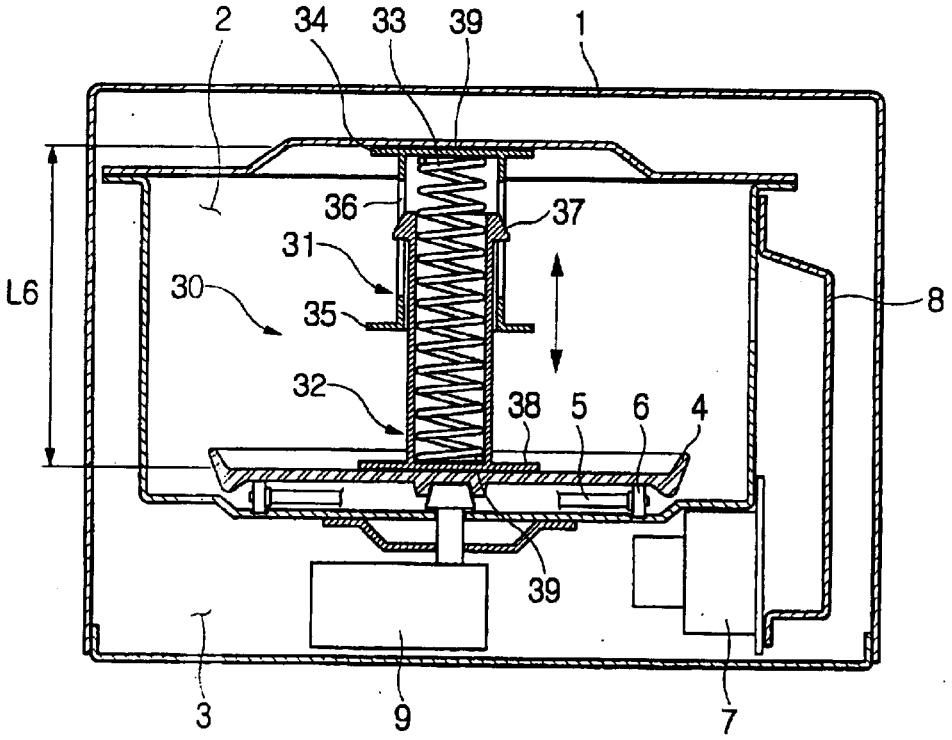
FIG. 5 is a sectional view of a microwave oven with the tray holding unit of FIG. 4 installed in a cooking cavity of the microwave oven according to the present invention.

As the two push handles 35 of the outer cylindrical part 31 are pushed downward relative to the inner cylindrical part 32, after assembling the two cylindrical parts 31 and 32 into a single structure, the outer cylindrical part 31 is axially moved downward relative to the inner cylindrical part 32 while pressing the elastic member 33. Where a pushing force is removed from the two handles 35, the outer cylindrical part 31 is elastically moved upward to its original position relative to the inner cylindrical part 32 by a restoring force of the elastic member 33.

Where no force is applied to the push handles 35, the original height L4 between the closed ends of the two cylindrical parts 31 and 32 is slightly longer than the height L6 between a top wall of the cooking cavity 2 and a top surface of the cooking tray 4 (see FIG. 5). Where the push handles 35 are fully pressed down, the reduced height L5 of the tray holding unit 30 is slightly shorter than the height L6 between the top wall of the cooking cavity 2 and the top surface of the cooking tray 4.

In order to install the tray holding unit 30 in the cooking cavity 2 to hold the cooking tray 4 and the tray guide 5 in their original positions, the tray holding unit 30 is seated in a space between the top wall of the cooking cavity 2 and the top surface of the cooking tray 4 while axially pressing the push handles 35 down to reduce the height of the tray holding unit 30. When the pushing force is removed from the push handles 35 after seating the tray holding unit 30 at a desired position inside the cooking cavity 2, the outer cylindrical part 31 is elastically moved upward relative to the inner cylindrical part 32 by the restoring force of the elastic member 33. In such a case, the closed end of the outer cylindrical part 31 is stopped by the top wall of the cooking cavity 2, while the closed end of the inner cylindrical part 32 biases the cooking tray 4 and the tray guide 5 downward. Therefore, the cooking tray 4 and the tray guide 5 are elastically held by the tray holding unit 30, which also effectively absorbs vibration and impact applied from the outside to the cooking tray 4 and the tray guide 5. The cooking tray 4 and the tray guide 5 are thus able to maintain their desired positions without being moved or damaged by the vibration and the impact.

To use the microwave oven for heating or cooking food, the tray holding unit 30 can be removed from the cooking cavity 2 by axially pressing the two push handles 35 of the outer cylindrical part 31 down to reduce the height of the tray holding unit 30. Therefore, removal of the tray holding unit 30 from the microwave oven is simple to accomplish.

As described above, the present invention provides a microwave oven provided with a tray holding unit which stably holds the cooking tray and the tray guide of the microwave oven so as to prevent the cooking tray and the tray guide from undesirably moving from their original positions regardless of vibration and impact applied to the microwave oven as the microwave oven is transported by a moving vehicle. Thus, the cooking tray and the tray guide of this microwave oven do not generate frictional noise, and are not damaged regardless of such vibration and impact. The microwave oven having the tray holding unit of this invention thus has an improved operational reliability and improved market competitiveness.

It is also understood that other types of ovens, such as portable toaster ovens and convention ovens, can be provided with a tray holding unit of the present invention to secure a cooking tray from moving regardless of vibration and impact applied to the cooking tray of such ovens.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A microwave oven comprising:

a cabinet which forms an appearance of the microwave oven;

a magnetron which generates microwaves and contained in the cabinet;

a cooking cavity defined inside the cabinet for containing food therein;

a tray guide having rollers and rotatably set in the cooking cavity;

a cooking tray laid on the rollers of the tray guide; and a tray holding unit which holds the cooking tray at a position to prevent the cooking tray from moving regardless of vibration or impact applied to the cooking tray and comprising a base part which extends in a horizontal direction, and elastic blade parts which are formed on a lower surface of the base part and extend downward from the lower surface of the base part while being inclined outward at an angle of inclination.

2. The microwave oven according to claim 1, further comprising a stop rail which is horizontally formed along inner sidewalls of the cooking cavity at a position vertically spaced apart from the cooking tray by a predetermined height, wherein the stop rail stops a top edge of the base part, and the elastic blade parts bias against the cooking tray so as to hold and not allow movement of the cooking tray and the tray guide.

3. The microwave oven according to claim 2, wherein the predetermined height between the stop rail and the cooking tray is shorter than a height of the tray holding unit in response to the elastic blade parts not being pressed, and longer than the height of the tray holding unit in response to the elastic blade parts being elastically pressed to a maximum state.

4. The microwave oven according to claim 1, wherein the tray holding unit is removably secured in the cooking cavity.

5. An oven comprising:

a heating source to cook food;

a cooking cavity for containing the food therein;

a cooking tray provided to the cooking cavity; and a removable tray holding unit which secures the cooking tray from moving from an original position and comprises a base part which extends in a horizontal direction, and elastic blade parts which are formed on a lower surface of the base part and extend downward from the lower surface of the base part while being inclined outward at an angle of inclination.

6. The oven according to claim 5, further comprising at least one stop rail which is formed along sidewalls of the cooking cavity at a corresponding position vertically spaced apart from the cooking tray by a predetermined height, wherein the stop rail stops a top edge of the base part, and the elastic blade parts bias against the cooking tray so as to hold and not allow movement of the cooking tray.

7. A microwave oven comprising:

a cabinet which forms an appearance of the microwave oven;

a magnetron which generates microwaves and contained in the cabinet;

a cooking cavity defined inside the cabinet for containing food therein;

a tray guide having rollers and rotatably set in the cooking cavity;

a cooking tray laid on the rollers of the tray guide;

a tray holding unit deformably inserted into the cooking cavity and which holds the cooking tray at a position to prevent the cooking tray from moving regardless of vibration or impact applied to the cooking tray; and projections at a predetermined height along sidewalls of the cooking cavity, wherein the projections maintain a predetermined height of the tray holding unit and the tray holding unit bias against the cooking tray.

8. A microwave oven comprising:

a cabinet which forms an appearance of the microwave oven;

a magnetron which generates microwaves and contained in the cabinet;

a cooking cavity defined inside the cabinet for containing food therein;

a tray guide having rollers and rotatably set in the cooking cavity;

a cooking tray laid on the rollers of the tray guide;

a tray holding unit deformably inserted into the cooking cavity and which holds the cooking tray at a position to prevent the cooking tray from moving regardless of vibration or impact applied to the cooking tray; and projections integrally formed with sidewalls of the cooking cavity at a predetermined height, wherein the projections maintain a predetermined height of the tray holding unit and the tray holding unit bias against the cooking tray.

* * * * *

UNITED STATES PATENT AND TRADEMARK OFFICE

CERTIFICATE OF CORRECTION

PATENT NO. : 6,852,962 B2
DATED : February 8, 2005
INVENTOR(S) : Han-Seong Kang et al.

It is certified that error appears in the above-identified patent and that said Letters Patent is hereby corrected as shown below:

Title page,
Item [73], Assignee, change "Samsung Electronic Co. Ltd." to -- Samsung Electronics Co. Ltd. --.

Signed and Sealed this

Twenty-second Day of November, 2005

JON W. DUDAS
*Director of the United States Patent and Trademark Office*